US011437714B2

(12) United States Patent
Zhang

(10) Patent No.: US 11,437,714 B2
(45) Date of Patent: Sep. 6, 2022

(54) RADIATING ELEMENTS HAVING PARASITIC ELEMENTS FOR INCREASED ISOLATION AND BASE STATION ANTENNAS INCLUDING SUCH RADIATING ELEMENTS

(71) Applicant: CommScope Technologies LLC, Hickory, NC (US)

(72) Inventor: Xun Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 130 days.

(21) Appl. No.: 17/025,426

(22) Filed: Sep. 18, 2020

(65) Prior Publication Data

US 2021/0098864 A1 Apr. 1, 2021

(30) Foreign Application Priority Data

Sep. 27, 2019 (CN) ..... 201910920535.3

(51) Int. Cl.

| | |
|---|---|
| ***H01Q 1/24*** | (2006.01) |
| ***H01Q 19/02*** | (2006.01) |
| ***H01Q 21/06*** | (2006.01) |
| ***H01Q 5/378*** | (2015.01) |
| ***H01Q 1/52*** | (2006.01) |

(52) U.S. Cl.

CPC ..... *H01Q 1/246* (2013.01); *H01Q 1/24* (2013.01); *H01Q 1/523* (2013.01); *H01Q 5/378* (2015.01); *H01Q 19/02* (2013.01); *H01Q 19/021* (2013.01); *H01Q 21/06* (2013.01); *H01Q 21/062* (2013.01)

(58) Field of Classification Search

CPC ..... H01Q 1/246; H01Q 1/523; H01Q 21/062; H01Q 5/378; H01Q 19/021; H01Q 1/24; H01Q 21/06; H01Q 19/02

USPC ..... 343/833

See application file for complete search history.

(56) References Cited

U.S. PATENT DOCUMENTS

| | | | | |
|---|---|---|---|---|
| 9,257,741 | B2 * | 2/2016 | Cheng | H01Q 9/28 |
| 9,276,392 | B2 * | 3/2016 | Aase | B29C 43/18 |
| 2005/0179610 | A1 * | 8/2005 | Le | H01Q 21/28 343/797 |
| 2006/0279471 | A1 * | 12/2006 | Zimmerman | H01Q 9/26 343/797 |
| 2014/0139387 | A1 * | 5/2014 | Jones | H01Q 21/30 343/794 |

(Continued)

FOREIGN PATENT DOCUMENTS

WO 2017165512 A1 9/2017

OTHER PUBLICATIONS

"EP Search Report corresponding to EP Application No. 20198145.3, dated Mar. 1, 2021, 8 pgs."

(Continued)

*Primary Examiner* — Hai V Tran
(74) *Attorney, Agent, or Firm* — Myers Bigel, P.A.

(57) ABSTRACT

A radiating element comprises a radiator, a feed stalk and a parasitic element. The radiator is fed by the feed stalk, and the parasitic element includes an electrically conductive structure that includes a meandered electrically conductive path. A coupling capacitor is formed between the electrically conductive structure and the radiator, and a center frequency of an operating frequency band of the radiator is higher than a center frequency of a first operating frequency band of the parasitic element.

15 Claims, 11 Drawing Sheets

(56) References Cited

U.S. PATENT DOCUMENTS

2018/0191083 A1 7/2018 Daojian et al.
2018/0323513 A1* 11/2018 Varnoosfaderani ..... H01Q 9/16

OTHER PUBLICATIONS

Liu Ying, "A Novel Dual-Polarized Dipole Antenna with Compact Size for Wireless Communication", Progress in Electromagnetics Research C, vol. 40, Jan. 1, 2013, pp. 217-227, Jan. 1, 2013.

* cited by examiner

RADIATING ELEMENTS HAVING PARASITIC ELEMENTS FOR INCREASED ISOLATION AND BASE STATION ANTENNAS INCLUDING SUCH RADIATING ELEMENTS

CROSS-REFERENCE TO RELATED APPLICATION

The present application claims priority to Chinese Patent Application No. 201910920535.3, filed Sep. 27, 2019, the entire content of which is incorporated herein by reference as if set forth fully herein.

FIELD

The present invention generally relates to radio communications and, more particularly, to radiating elements and base station antennas for cellular communications systems.

BACKGROUND

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors." In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower structure, with the radiation patterns (also referred to herein as "antenna beams") that are generated by the base station antennas directed outwardly. Base station antennas are often implemented as linear or planar phased arrays of radiating elements.

Base station antennas often include a linear array or a two-dimensional array of radiating elements, such as crossed dipole or patch radiating elements. In order to increase system capacity, beam-forming base station antennas are now being deployed that include multiple closely-spaced linear arrays of radiating elements that are configured for beam-forming. A typical objective with such beam-forming antennas is to generate a narrow antenna beam in the azimuth plane. This increases the power of the signal transmitted in the direction of a desired user and reduces interference.

If the linear arrays of radiating elements in a beam-forming antenna are closely spaced together, it may be possible to scan the antenna beam to very wide angles in the azimuth plane (e.g., azimuth scanning angles of 60°) without generating significant grating lobes. However, as the linear arrays are spaced more closely together, mutual coupling increases between the radiating elements in adjacent linear arrays, which degrades other performance parameters of the base station antenna such as the co-polarization performance.

In addition, the number of the arrays of radiating elements is also limited by wind loading, manufacturing cost and industry regulations, so a large base station antenna (large in size and heavy in weight) is also undesirable.

SUMMARY

According to a first aspect of the present invention, a radiating element is provided. The radiating element comprises a radiator, a feed stalk and a parasitic element, wherein the radiator is fed by the feed stalk, wherein the parasitic element includes an electrically conductive structure and the electrically conductive structure comprises a meandered electrically conductive path, and a coupling capacitor is formed between the electrically conductive structure and the radiator, and wherein a center frequency of an operating frequency band of the radiator is higher than a center frequency of a first operating frequency band of the parasitic element.

With the radiating elements in accordance with some embodiments of the present invention, at least the coupling interference between the arrays can be reduced, thus improving the isolation performance. Further, the radiating elements according to some embodiments of the present invention are also reduced in size, thus rendering the radiating elements more compact.

In some embodiments, the operating frequency band of the radiator is more than twice the first operating frequency band of the parasitic element.

In some embodiments, the radiator extends a first distance in a horizontal direction H, and the parasitic element extends a second distance in the horizontal direction H, wherein the second distance is smaller than the first distance; and/or the radiator extends a third distance in a vertical direction V, and the parasitic element extends a fourth distance in the vertical direction V, wherein the fourth distance is smaller than the third distance.

In some embodiments, the parasitic element is disposed on or above the radiator and/or extends substantially parallel to the radiator.

In some embodiments, the radiating element comprises a director, which is disposed above the parasitic element.

In some embodiments, the parasitic element includes a first dielectric structure, and the electrically conductive structure of the parasitic element is disposed on or inside the first dielectric structure.

In some embodiments, the parasitic element is configured as a first printed circuit board component, and the electrically conductive structure is configured as an electrically conductive trace printed on the first printed circuit board component.

In some embodiments, the printed electrically conductive trace is configured as a meandered trace ring.

In some embodiments, the electrically conductive structure of the parasitic element is configured as a meandered metal ring.

In some embodiments, the parasitic element has an opening.

In some embodiments, the electrically conductive structure surrounds the opening.

In some embodiments, an inductive segment is provided on the radiator.

In some embodiments, an overall extending length of the electrically conductive structure is in the range of 20% to 80% of a first length, wherein the first length is equal to a wavelength corresponding to the center frequency of the operating frequency band of the parasitic element.

In some embodiments, the overall extending length of the electrically conductive structure is in the range of 40% to 60% of the first length.

In some embodiments, the radiator includes a first dipole and a second dipole, the first dipole includes a first dipole arm and a second dipole arm, the second dipole includes a third dipole arm and a fourth dipole arm, and the second dipole extends substantially perpendicular to the first dipole.

In some embodiments, the radiating element includes a second printed circuit board component, and the first dipole and the second dipole are configured as printed electrically conductive segments on the second printed circuit board component.

In some embodiments, at least 50%, 60%, 70% of a projection of the electrically conductive structure of the parasitic element on a plane, on which the radiator is located, falls within the radiator.

In some embodiments, at least 80%, 90% of a projection of the electrically conductive structure of the parasitic element on a plane, on which the radiator is located, falls within the radiator.

In some embodiments, a projection of the electrically conductive structure of the parasitic element on a plane, on which the radiator is located, falls substantially completely within the radiator.

In some embodiments, a second dielectric structure is disposed between the parasitic element and the radiator.

According to a second aspect of the present invention, a radiating element is provided. The radiating element comprises a radiator, a feed stalk and a parasitic element, wherein the radiator is fed by the feed stalk, wherein the parasitic element includes an electrically conductive structure disposed at a distance from the radiator, and a coupling capacitor is formed between the electrically conductive structure and the radiator, and wherein the radiator extends a first distance in a horizontal direction H, and the parasitic element extends a second distance in the horizontal direction H, the second distance being smaller than the first distance.

In some embodiments, the radiator extends a third distance in a vertical direction V, and the parasitic element extends a fourth distance in the vertical direction V, the fourth distance being smaller than the third distance.

In some embodiments, an operating frequency band of the radiating element is a first frequency band, an operating frequency band of the parasitic element is a second frequency band, and the second frequency band is configured as a lower sub-band within the first frequency band.

In some embodiments, an overall extending length of the electrically conductive structure is in the range of 30% to 70% of a first length, wherein the first length is equal to a wavelength corresponding to a center frequency of the second frequency band.

In some embodiments, length, width and area of the radiator are all larger than length, width and area of the parasitic element.

In some embodiments, the parasitic element extends substantially parallel to the radiator.

In some embodiments, the parasitic element is disposed on or above the radiator.

In some embodiments, the electrically conductive structure of the parasitic element comprises a meandered electrically conductive segment.

In some embodiments, the parasitic element includes a first dielectric structure, and the electrically conductive structure of the parasitic element is disposed on or inside the first dielectric structure.

In some embodiments, the parasitic element is configured as a first printed circuit board component, and the electrically conductive structure is configured as an electrically conductive trace printed on the first printed circuit board component.

In some embodiments, the electrically conductive trace is configured as a meandered trace ring.

In some embodiments, the electrically conductive structure of the parasitic element is configured as a meandered metal ring.

In some embodiments, the radiating element comprises a director, which is disposed above the parasitic element.

According to a third aspect of the present invention, a radiating element is provided. The radiating element comprises a radiator, a feed stalk and a parasitic element, wherein the radiator is fed by the feed stalk, and wherein the parasitic element comprises a conductive structure comprising a meandered metal conductive path, and a coupling capacitor is formed between the metal conductive path and the radiator.

In some embodiments, the metal conductive path is configured as a metal ring.

In some embodiments, the parasitic element is configured as a first printed circuit board component, and the metal conductive path is configured as an electrically conductive trace printed on the first printed circuit board component.

In some embodiments, the parasitic element is disposed on or above the radiator.

In some embodiments, the radiating element comprises a director, which is disposed above the parasitic element.

According to a forth aspect of the present invention, a base station antenna is provided, the base station antenna comprises a first linear array of radiating elements and a second linear array of radiating elements each composed of a plurality of radiating elements, characterized in that the radiating elements are configured as the radiating elements according to any one of the embodiments of the present invention.

In some embodiments, a radiator of a radiating element in the first linear array of radiating elements is spaced from a radiator of an adjacent radiating element in the second linear array of radiating elements with a first spacing, and a parasitic element of a radiating element in the first linear array of radiating elements is spaced from a parasitic element of an adjacent radiating element in the second linear array of radiating elements with a second spacing, the second spacing being greater than the first spacing.

In some embodiments, the second spacing is in the range of 30% to 70% of a second length, wherein the second length is equal to a wavelength corresponding to a center frequency of an operating frequency band of the parasitic element.

In some embodiments, the second spacing is in the range of 40% to 60% of a second length, wherein the second length is equal to a wavelength corresponding to a center frequency of an operating frequency band of the parasitic element

DETAILED DESCRIPTION

Figure 1:
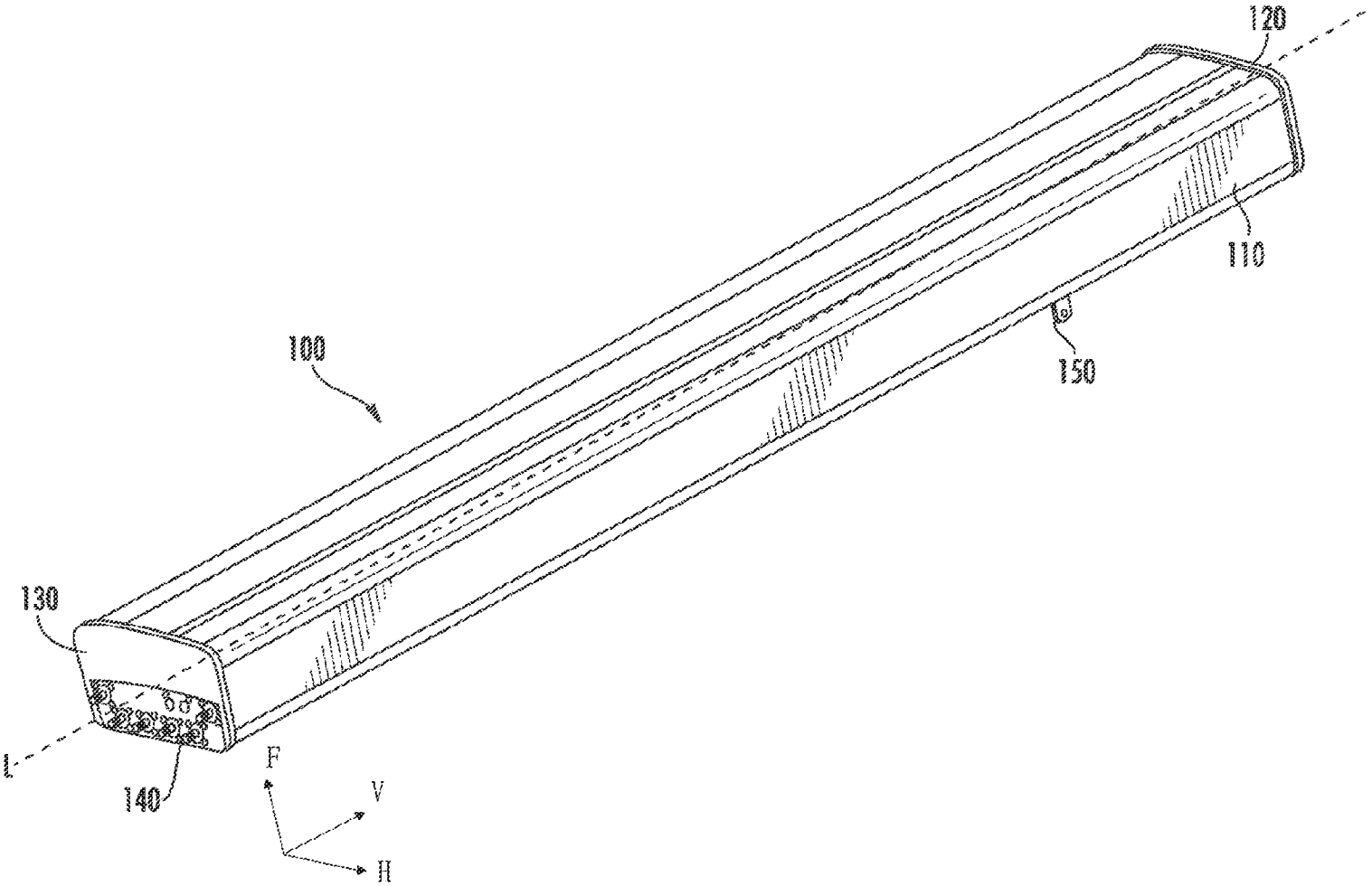
FIG. 1 is a schematic perspective view of a base station antenna according to some embodiments of the present invention.

The present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It should also be understood that, the embodiments disclosed herein can be combined in various ways to provide many additional embodiments.

It should be understood that, in all the drawings, the same reference signs present the same elements. In the drawings, for the sake of clarity, the sizes of certain features may be modified.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the items listed. The phases "between X and Y" and "between about X and Y" as used in the specification should be construed as including X and Y. As used herein, phrases such as "between about X and Y" mean "between about X and about Y". As used herein, phrases such as "from about X to Y" mean "from about X to about Y."

In the specification, when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being "directly on", "directly attached" to, "directly connected" to, "directly coupled" with or "directly contacting" another element, there are no intervening elements present. In the specification, references to a feature that is disposed "adjacent" another feature may have portions that overlap, overlie or underlie the adjacent feature.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs present the same elements. In the drawings, for the sake of clarity, the sizes of certain features may be modified.

The radiating elements according to embodiments of the present invention are applicable to various types of base station antennas, and may be particularly suitable for beamforming antennas that include multi-column arrays of radiating elements.

As the number of linear arrays of radiating elements mounted on a reflector of the base station antenna increases, the spacing between radiating elements of different linear arrays is typically decreased. As the spacing between radiating elements of adjacent arrays is reduced, the arrays experience increased coupling interference. Such coupling interference between adjacent linear arrays is undesirable as it may distort the radiation pattern in both the azimuth and elevation planes, and thus the beamforming performance of the multi-column array may be degraded. Excessive coupling may also negatively impact the gain of the array (due to coupling loss) and/or may degrade the cross-polarization discrimination (CPR) performance of the antenna.

In addition, as the number of the arrays of radiating elements increases, so does the size of a base station antenna. This is also undesirable because large base station antennas may have very high wind loading, may be very heavy, and/or may be expensive to manufacture.

With the radiating elements in accordance with some embodiments of the present invention, the coupling interference between the arrays can be reduced, thus improving the isolation performance. Further, the radiating elements according to some embodiments of the present invention may also be reduced in size as compared to conventional radiating elements that have similar performance, thus facilitating reducing the size of the base station antenna.

Embodiments of the present invention will now be described in more detail with reference to the accompanying drawings.

Figure 2:
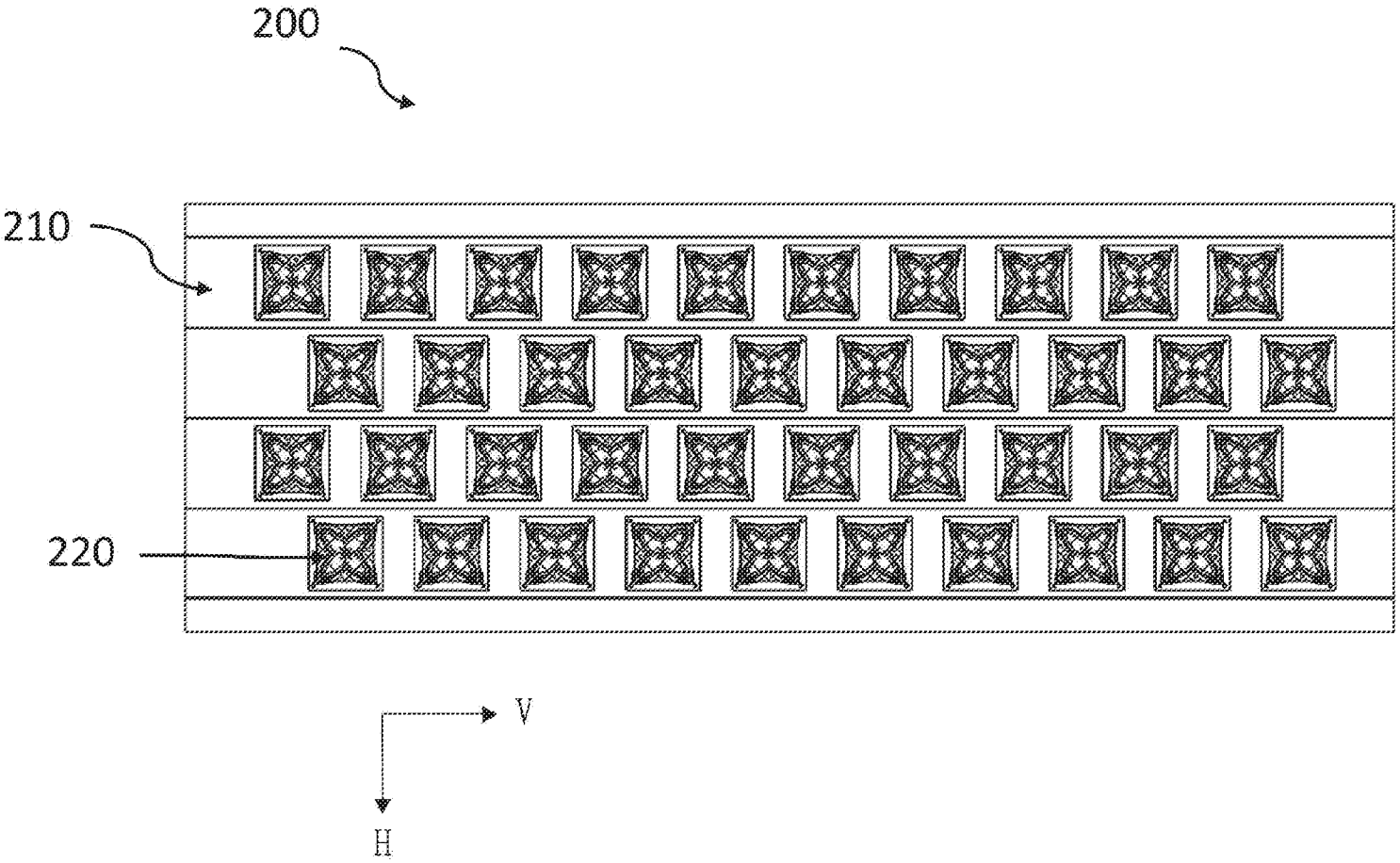
FIG. 2 is a schematic top view of arrays of radiating elements in the base station antenna of FIG. 1 with the radome removed.

FIG. 1 is a schematic perspective view of a base station antenna 100 according to some embodiments of the present invention. FIG. 2 is a schematic top view of the base station antenna 100 with a radome thereof removed to show the arrays of radiating elements included in the antenna.

As shown in FIG. 1, the base station antenna 100 is an elongated structure that extends along a longitudinal axis L. The base station antenna 100 may have a tubular shape with a generally rectangular cross-section. The base station antenna 100 includes a radome 110 and a top end cap 120. In some embodiments, the radome 110 and the top end cap 120 may comprise a single integral unit. One or more mounting brackets 150 are provided on the rear side of the radome 110 which may be used to mount the base station antenna 100 onto an antenna mount (not shown) on, for example, an antenna tower. The base station antenna 100 also includes a bottom end cap 130 which includes a plurality of connectors 140 mounted therein. The base station antenna 100 is typically mounted in a vertical configuration (i.e., the longitudinal axis L may be generally perpendicular to a plane defined by the horizon when the base station antenna 100 is mounted for normal operation).

As shown in FIG. 2, the base station antenna 100 includes an antenna assembly 200 that may be slidably inserted inside the radome 110 from either the top or bottom before the top cap 120 or bottom cap 130 is attached to the radome 110. The antenna assembly 200 includes a reflector 210 and arrays of radiating elements 220 mounted on or above the reflector 210. The reflector 210 may be used as a ground plane for the radiating elements 220.

The arrays may be, for example, linear arrays of radiating elements or two-dimensional arrays of radiating elements. In some embodiments, the arrays of radiating elements 220 may extend substantially along the entire length of the base station antenna 100. In other embodiments, the arrays of radiating elements 220 may extend only partially along the length of base station antenna 100. The arrays of radiating elements 220 may extend from a lower end portion to an upper end portion of the base station antenna 100 in a vertical direction V, which may be the direction of a longitudinal axis L of the base station antenna 100 or may be parallel to the longitudinal axis L. The vertical direction V is perpendicular to a horizontal direction H and a forward direction F (see FIG. 1). The arrays of radiating elements may extend forward from the reflector in the forward direction F.

In the depicted embodiment, only four linear arrays of radiating elements are exemplarily shown. In other embodiments, additional arrays of radiating elements (e.g., a plurality of arrays of high band radiating elements, a plurality of arrays of mid-band radiating elements and/or a plurality of arrays of low band radiating elements) may also be mounted on the reflector 210. The arrays of radiating elements may operate in the same or different operating frequency bands. For example, some of the radiating elements 220 may be low-band radiating elements that operate in the 617 MHz to 960 MHz frequency band, or one or more portions thereof, others of the radiating elements 220 may be mid-band radiating elements that operate in the 1695 MHz to 2690 MHz frequency band, or one or more portions thereof, and additional a further part of the radiating elements 220 may be high-band radiating elements that may operate in the 3 GHz or 5 GHz frequency bands, or one or more portions thereof.

It should be noted that herein the operating frequency band may, for example, refer to a frequency band for which the antenna will experience a gain drop of no more than 3 dB or a frequency band for which a prescribed standing wave ratio may be met (such as 1.5).

In the discussion that follows, the radiating elements 220 are described consistent with their orientation as shown in the figures. It will be appreciated that the base station antennas 100 are typically mounted so that a longitudinal axis L thereof extends in the vertical direction V, and the reflector 210 of the base station antennas 100 likewise extends vertically. When mounted in this fashion, the radiating elements 220 typically extend forward from the reflector 210, and hence are rotated about 90° from the orientations shown in the figures.

Figure 3A:
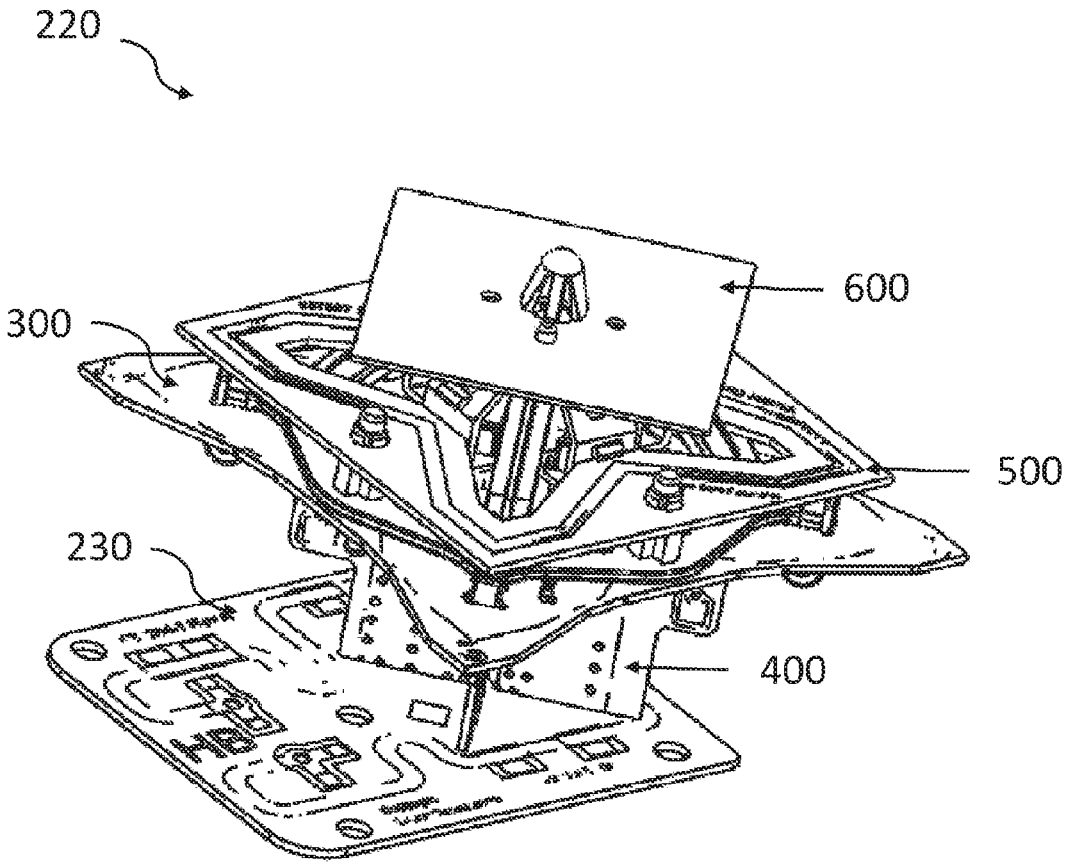
FIG. 3*a* is a schematic perspective view of a radiating element according to some embodiments of the present invention.
Figure 3B:
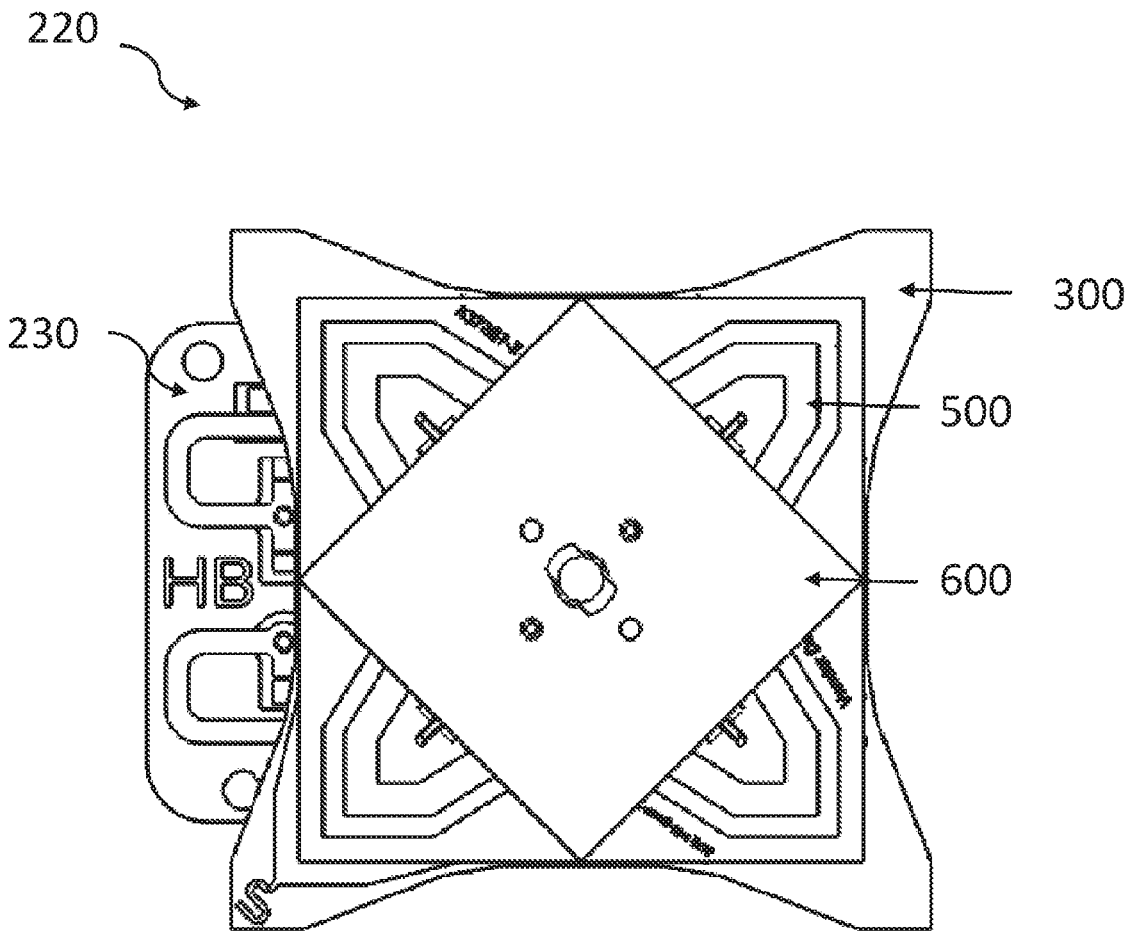
FIG. 3*b* is a schematic top view of the radiating element of FIG. 3*a*.
Figure 3C:
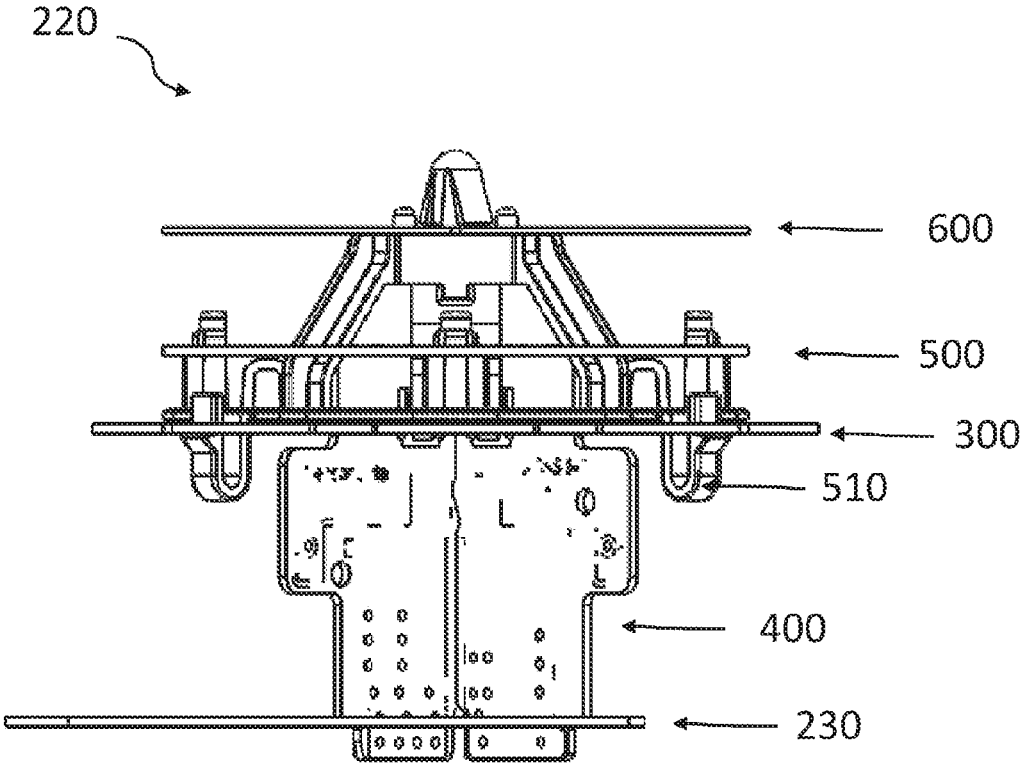
FIG. 3*c* is a schematic side view of the radiating element of FIG. 3*a*.

Next, the radiating element 220 according to some embodiments of the present invention will be described in detail with reference to FIGS. 3*a* to 5. FIG. 3*a* is a schematic perspective view of one of the radiating elements 220 according to embodiments of the present invention. FIG. 3*b* is a schematic top view of the radiating element 220 of FIG. 3*a*. FIG. 3*c* is a schematic side view of the radiating element 220 of FIG. 3*a*.

The radiating element 220 is mounted on a first printed circuit board 230. The first printed circuit board 230 includes a radio frequency (RF) transmission line that is capable of feeding an RF signal to the radiating element 220 or receiving an RF signal from the radiating element 220. The first printed circuit board 230 may be a so-called "feed board" that is mounted parallel to the reflector 210. The feed board 230 may have one or more radiating elements 220 mounted thereon, and may include circuitry such as power divider circuits, transmission lines and the like. In some cases, the first printed circuit board 230 may be omitted and coaxial cables or other transmission line structures may be directly connected to the radiating element 220.

The radiating element 220 includes a radiator 300, a feed stalk 400, a parasitic element 500, and (optionally) a director 600. As best seen in FIGS. 3*a* and 3*b*, the parasitic element 500 may be configured as a first printed circuit board component and may be disposed above the radiator 300, for example, the parasitic element 500 may be supported above the radiator 300 by means of a fastening mechanism 510 (see FIG. 3*c*). The radiator 300 may be implemented on a second printed circuit board component and configured as a printed electrically conductive segment on the second printed circuit board component. The radiator 300 may be supported on or above the feed stalk 400 and in the depicted embodiment is mounted directly on the feed stalk 400. The feed stalk 400 may be configured as a pair of third printed circuit board components each of which have an RF transmission line thereon, which allows transmission of RF signals between the first printed circuit board 230 and the radiator 300. In other embodiments, the radiator 300 may also be configured as a sheet metal, for example, a copper radiator or an aluminum radiator which may or may not be mounted on a dielectric mounting substrate. The feed stalk 400 may alternatively be configured as a sheet metal, for example, a copper feed stalk or an aluminum feed stalk. The director 600, if provided, may be supported on or above the parasitic element 500 to improve the radiation pattern generated by the array(s) of radiating elements 220.

Figure 4A:
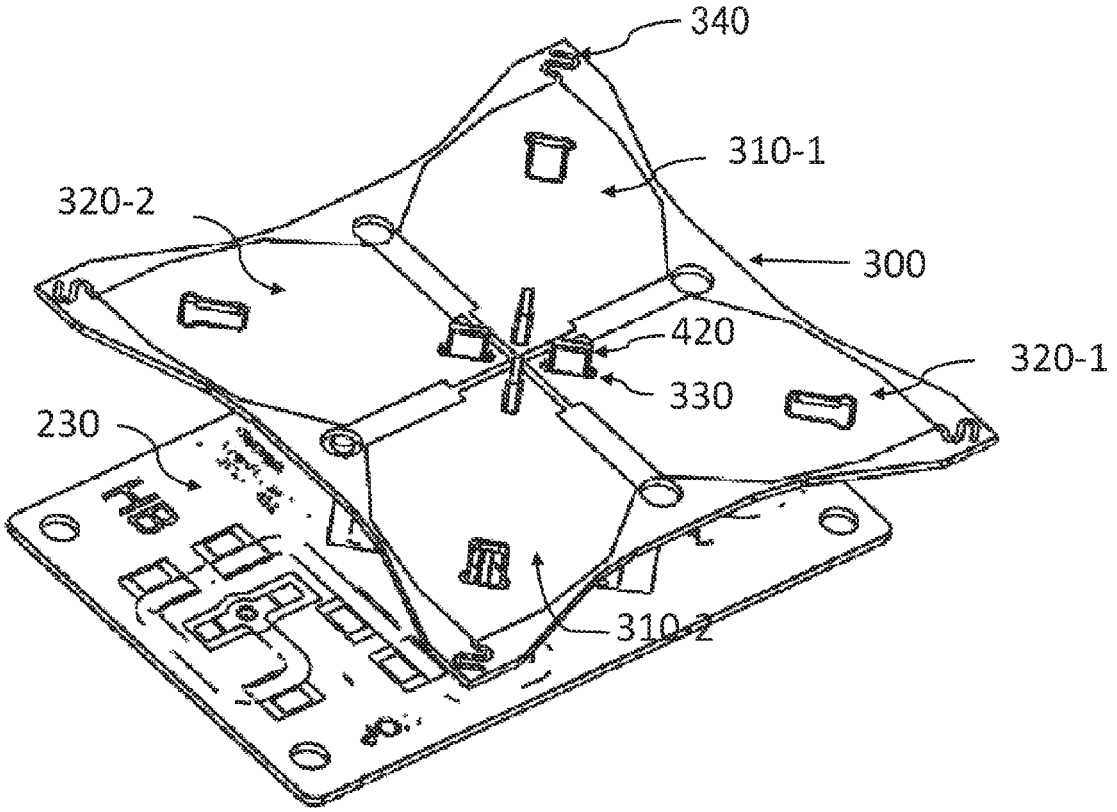
FIG. 4*a* is a schematic perspective view of the radiating element of FIGS. 3*a* to 3*c* with the parasitic element and the director removed.
Figure 4B:
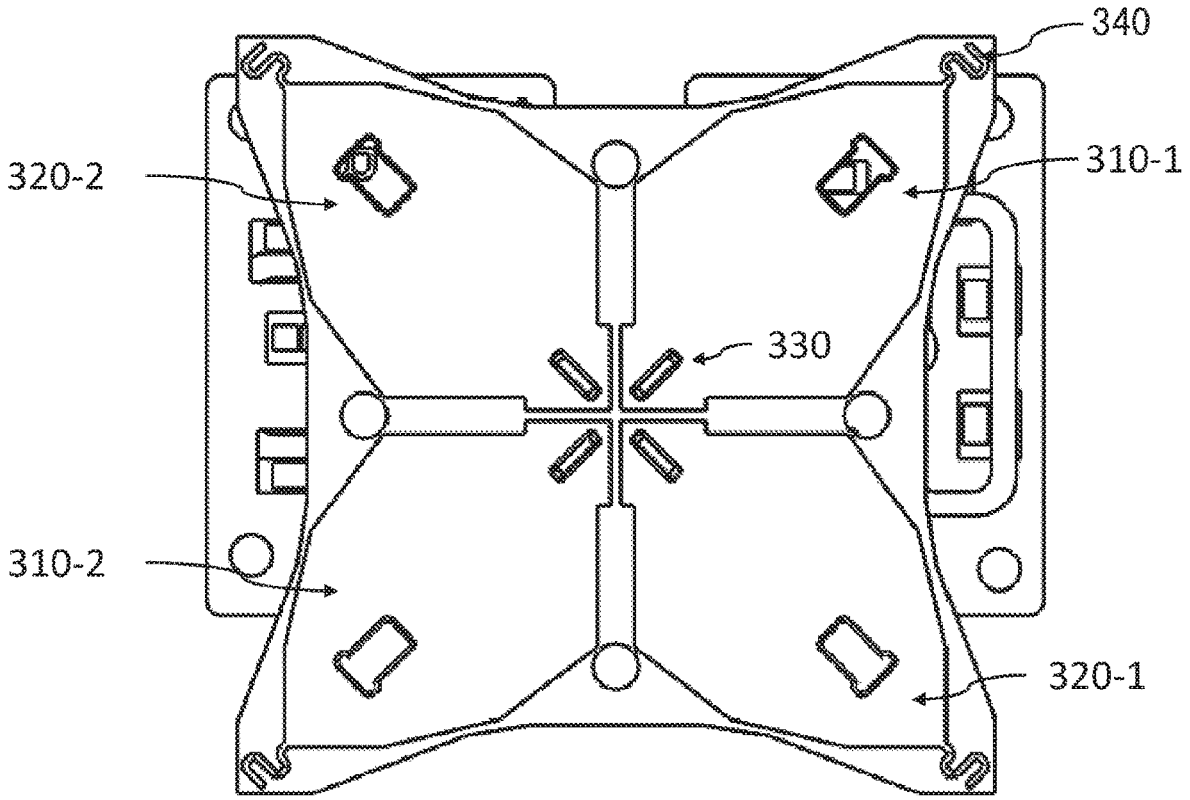
FIG. 4*b* is a schematic top view of the radiating element of FIG. 4*a*.
Figure 4C:
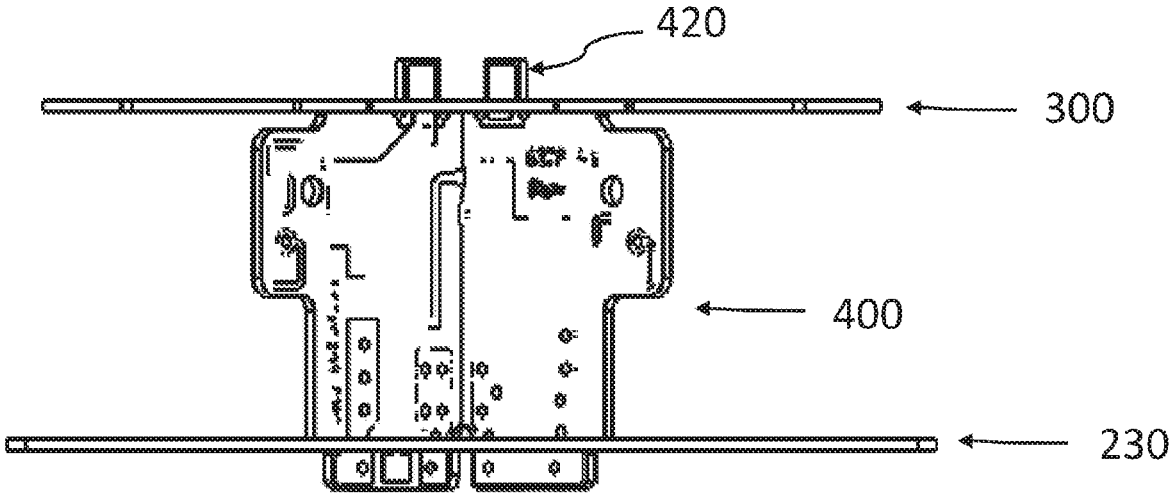
FIG. 4*c* is a schematic side view of the radiating element of FIG. 4*a*.

Referring now to FIGS. 4*a*, 4*b*, 4*c* and 5, in which FIG. 4*a* is a schematic perspective view of the radiating element 220 of FIGS. 3*a* to 3*c* with the parasitic element and the director removed, FIG. 4*b* is a schematic top view of the radiating element of FIG. 4*a*, and FIG. 4*c* is a schematic side view of the radiating element of FIG. 4*a*.

As best seen in FIGS. 4*a* and 4*b*, the radiating element 220 includes a radiator 300 that may be configured as a dual-polarized dipole radiator. The radiator 300 may include a first dipole 310 which may include a first dipole arm 310-1 and a second dipole arm 310-2, and a second dipole 320 which may include a first dipole arm 320-1 and a second dipole arm 320-2. The upper portion of the feed stalk 400 of radiating element 220 may include plated protrusions 420 which are embedded into slots 330 in the radiator 300 and soldered to the radiator 300, thereby mechanically and electrically connecting the feed stalk 400 to the radiator 300. In other embodiments, a coupling feed may be formed between the feed stalk 400 and the radiator 300.

In order to improve the isolation performance of the base station antenna 100, the radiator 300, which may be designed to operate in a particular operating frequency band, may have reduced extension in the horizontal direction H and/or the vertical direction V so as to make the radiator 300, and thus the radiating element 220, more compact. However, a decrease in the dimension of the radiator 300 may degrade the RF performance of the radiator 300 in a lower portion of the operating frequency band thereof. For example, if the radiator 300 is designed to transmit and receive RF signals over the entire operating frequency band of 694-960 MHz, a center frequency of the operating frequency band will be 827 MHz and the corresponding operating wavelength will be 36.25 cm (wherein the "operating wavelength" may be the wavelength corresponding to the center frequency of the operating frequency band of the radiator 300). Typically, in order to enable the radiator 300 to meet the requirements for RF performance, the dipole arms 310-1, 310-2, 320-1, 320-2 of the radiator 300 need to be within a prescribed range of length, for example, may be designed to have a length about 0.2 to 0.35 times the operating wavelength (that is, about 7.25 cm to 12.69 cm). However, with a decrease in the length of the dipole arms 310-1, 310-2, 320-1, 320-2 of the radiator 300, the RF performance of the radiator 300 in a lower portion of the operating frequency range (for example, the 694-747 MHz sub-band) may be degraded.

In order to compensate for the RF performance of the radiator 300 in the lower sub-band, the radiating element 220 in accordance with embodiments of the present invention may include a parasitic element 500. To this end, the center frequency of the operating frequency band of the radiator 300 of radiating element 220 is higher than a center frequency of a first operating frequency band of the parasitic element 500.

It should be noted that in the present invention, the first operating frequency band of the parasitic element 500 should be construed as the remaining frequency band after the operating frequency band of the radiating element 220 minus the operating frequency band of the radiator 300. The operating frequency band of the radiating element 220 and the operating frequency band of the radiator 300 may be obtained under a predetermined criterion (such as 3 dB gain criterion or a return loss criterion). The operating frequency band of the radiator 300 may be measured with the corresponding parasitic element 500 removed in a lab.

For example, the operating frequency bands of the radiating element 220 and the radiator 300 may be determined as the operating frequency band where the return loss is below −10 dB. The operating frequency band of the radiating element 220 may then be determined in the lab via a return loss measurement. As an example, the return loss measurement may show that the operating frequency band of the radiating element 220 is 1680-2700 MHz. The operating frequency band of the radiator 300 may also be determined in the lab by removing the parasitic element 500 and performing a return loss measurement on the radiating element 220. As an example, the operating frequency band of the radiator 300 may be found to be 1800-2700 MHz. In this example, the first operating frequency band of the parasitic element 500 may then be calculated as 1680-1800 MHz.

The actual operating frequency band of parasitic element 500 may be greater than or equal to the first operating frequency band. When there is no overlap between the operating frequency band of the radiator 300 and the operating frequency band of the parasitic element 500, the operating frequency band of the parasitic element 500 is equal to the first operating frequency band. When there is an overlap between the operating frequency band of the radiator 300 and the operating frequency band of the parasitic element 500, the operating frequency band of the parasitic element 500 is larger than the first operating frequency band and the overlap frequency band is regarded as a second operating frequency band of the parasitic element 500. The actual operating frequency band of the parasitic element 500 may be measured with the radiator 300 removed in the lab.

In some embodiments, the operating frequency band of the radiator 300 is more/wider than twice, four, six, eight, or even ten times the first operating frequency band of the parasitic element 500. In particular, the radiator 300 may be designed for a higher sub-band within the operating frequency band of the radiating element 220, whereas the parasitic element 500 may be designed for a lower (and smaller) sub-band within the operating frequency band of the radiating element 220. For example, if the radiating element 220 operates in 694-960 MHz frequency band, the radiator 300 may be designed for a higher sub-band (for example, 747-960 MHz) within the operating frequency band of the radiating element 220, while the parasitic element 500 may be designed for a lower sub-band (for example, 694-747 MHz) within the operating frequency band of the radiating element 220. In some embodiments, the higher sub-band and the lower sub-band may overlap each other.

Figure 5:
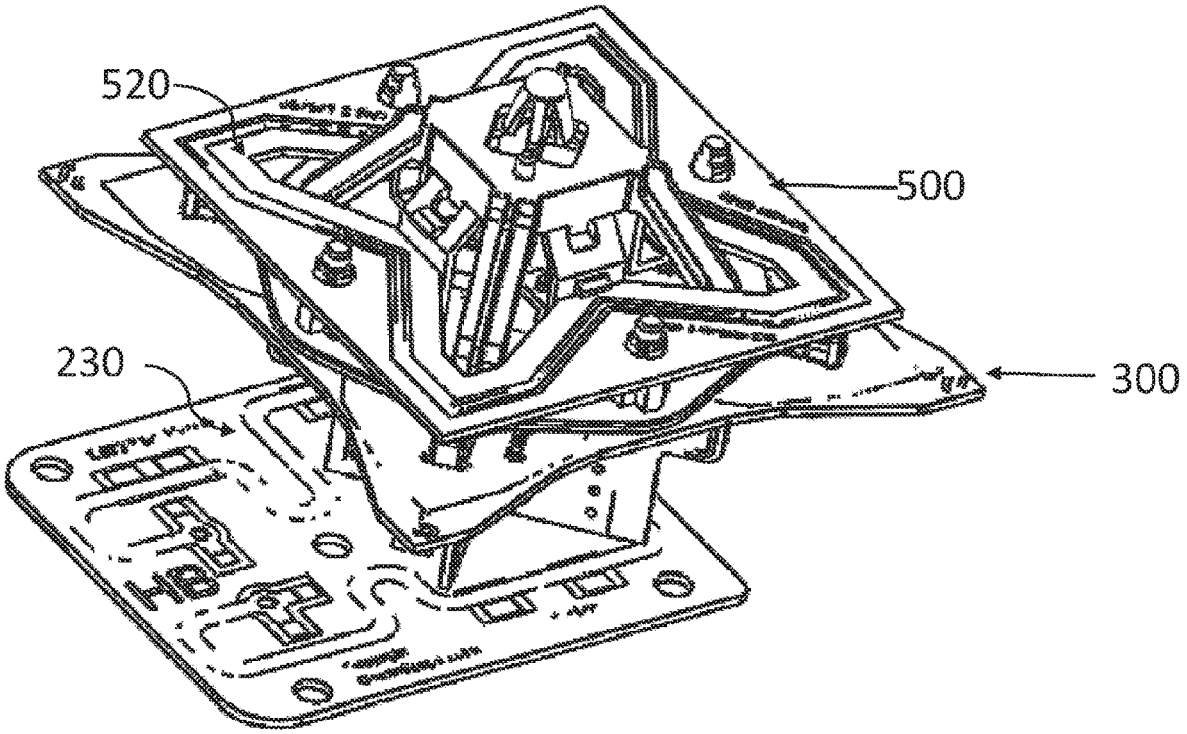
FIG. 5 is a schematic perspective view of the radiating element of FIGS. 3*a* to 3*c* with the director removed.
Figure 6A:
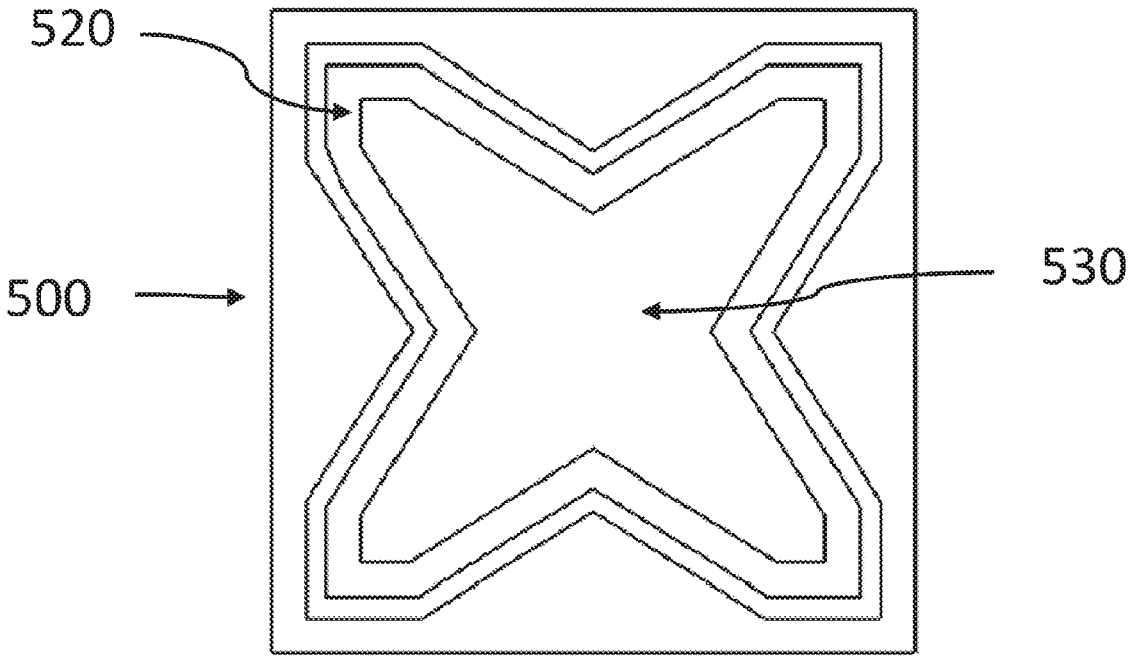
FIG. 6*a* is a schematic view of a parasitic element according to some embodiments of the present invention.
Figure 6B:
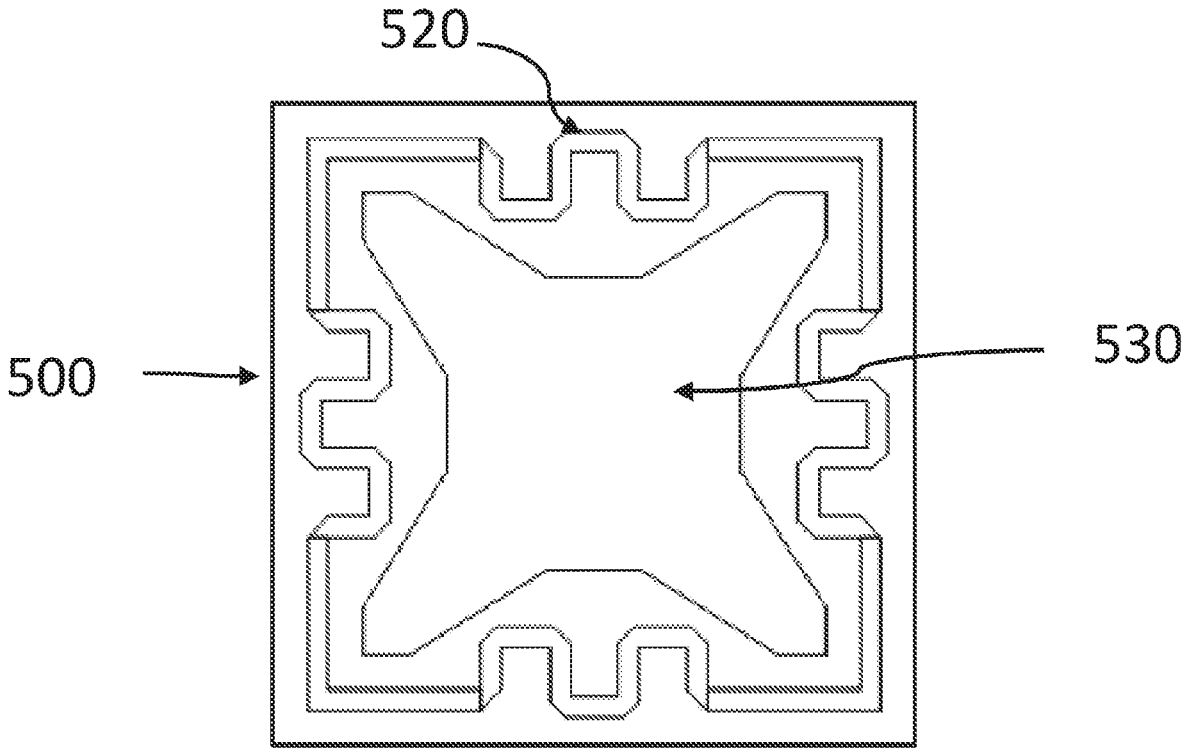
FIG. 6*b* is a schematic view of a parasitic element according to further embodiments of the present invention.

The parasitic element 500 of the radiating element 220 will be explained in detail below with reference to FIGS. 5, 6*a* and 6*b*, in which FIG. 5 is a schematic perspective view of the radiating element of FIGS. 3*a* to 3*c* with the director removed, FIG. 6*a* is a schematic view of a parasitic element according to some embodiments of the present invention, and FIG. 6*b* is a schematic view of a parasitic element according to further embodiments of the present invention.

Referring to FIG. 5, the parasitic element 500 may be configured as a first printed circuit board component that includes an electrically conductive structure 520 provided thereon. The electrically conductive structure 520 may be a printed electrically conductive segment or electrically conductive trace, such as a printed copper segment, on the first printed circuit board component. The electrically conductive structure 520 may be configured to be "electrically floating", that is, the electrically conductive structure 520 is not electrically connected to other electrically conductive elements of radiating element 220. The parasitic element 500 may be disposed above the radiator 300 by means of a fastening mechanism 510 and may extend substantially parallel to the radiator 300. Thus, a coupling capacitor is formed between the electrically conductive structure 520 and the radiator 300, by means of which the electrically conductive structure 520 can be fed. In other embodiments, the parasitic element 500 may instead be disposed below the radiator 300. However, it may be more advantageous to dispose the parasitic element 500 above the radiator 300, because the RF signal within the lower sub-band has a relatively long wavelength and thus requires a longer feed path.

Further, as can be best seen from FIGS. 4*a* and 4*b*, an inductive segment 340, such as a printed meandered trace segment, may be disposed on the dipole arms 310-1, 310-2, 320-1, 320-2 of radiator 300, for example, on a distal end of the dipole arms opposite a feed end. The inductive segment 340 functions to match the coupling capacitor formed between the electrically conductive structure 500 and the radiator 300.

In some embodiments, the electrically conductive structure 520 of the parasitic element 500 may include a meandered electrically conductive segment. For example, when the electrically conductive structure 520 is configured as an electrically conductive trace printed on the first printed circuit board component, the printed electrically conductive trace may be configured as a meandered trace ring (as shown in FIGS. 6*a* and 6*b*). It is advantageous to design the electrically conductive structure 520 of the parasitic element 500 in a meandered form, because the "meandered electrically conductive segment" increases the overall length of the electrically conductive path within a limited area of the parasitic element 500, which not only contributes to the compactness of the parasitic element 500 but also improves the RF performance of the parasitic element 500 in the lower sub-band of the radiating element 220.

In some embodiments, referring to FIGS. 6*a* and 6*b*, the parasitic element 500 may have an opening 530, around which the electrically conductive structure 520 may be disposed. It is advantageous to provide the opening 530 in the parasitic element 500 because the material saving effectively reduce the manufacturing cost of the parasitic element 500. Moreover, as the electrically conductive structure 520 of the parasitic element 500 is primarily designed for relatively narrow sub-band of the radiating element 220, the area of the electrically conductive structure 520 may be relatively narrowly constructed. The shape of the electrically conductive structure 520 of the parasitic element 500 may be varied, and with reference to FIGS. 6*a* and 6*b*, only two possible implementing modes are exemplarily shown. In other embodiments, the parasitic element 500 may also have no opening 530, and the electrically conductive structure 520 of the parasitic element 500 may be designed in any other suitable meandered shape depending on the particular operating frequency band.

In order to effectively feed the electrically conductive structure 520 of the parasitic element 500, at least 70%, 80% or 90% of a projection of the electrically conductive structure 520 on a plane defined by the radiator 300 falls within the radiator, so that coupling feed between the electrically conductive structure 520 and the radiator 300 is more efficient. In some embodiments, a dielectric structure having a high dielectric constant (a dielectric constant between 3 and 40) may be included between the electrically conductive structure 520 and the radiator 300 to further improve the coupling feed. For example, when the parasitic element 500 is configured as a printed circuit board component, the dielectric structure may be configured as a substrate layer of the printed circuit board, in which case the parasitic element 500 may be disposed directly on the radiator 300, for example, may be adhered to the radiator 300 by means of an adhesive layer.

In some embodiments, the parasitic element 500 may be formed of sheet metal, such as copper or aluminum, and the electrically conductive structure 520 may be configured as a meandered metal ring.

In some embodiments, the electrically conductive structure 520 may not be a closed loop.

In some embodiments, in order to further reduce the size of the parasitic element 500, the parasitic element 500 may include a dielectric structure having a high dielectric constant (a dielectric constant between 3 and 40), and the electrically conductive structure 520 of the parasitic element 500 may be placed on or inside the dielectric structure. This effectively increases the effective electrical length of the electrically conductive structure 520 of the parasitic element 500 for the RF signals.

In some embodiments, the extension of the radiator 300 in the horizontal direction H may be larger than the extension of the parasitic element 500 in the horizontal direction H, and/or the extension of the radiator 300 in the vertical direction V may be larger than the extension of the parasitic element 500 in the vertical direction V. In other words, the length, width, and/or area of the radiator 300 may all be larger than the length, width, and area of the parasitic element 500.

Such a design of the radiating element 220 is advantageous in that: the spacing between the parasitic elements 500, or more precisely between the electrically conductive structures 520, of adjacent radiating elements 220 can be greater than the spacing between the radiators 300 of adjacent radiating elements 220, thereby further reducing the coupling interference between adjacent radiating elements (arrays) 220, especially in the lower sub-band within the operating frequency bands thereof. As the RF signal within the lower sub-band has a relatively long wavelength, the larger spacing between the parasitic elements 500 of adjacent radiating elements (arrays) 220 can attenuate, to a greater extent, the coupling interference of the RF signals within the lower sub-band. Advantageously, the spacing between the parasitic elements 500 of adjacent radiating elements (arrays) 220 may be set under consideration of the electrical characteristics of the RF signal within the lower sub-band (for example, the amplitude and/or phase of the RF signal). For example, the spacing between the parasitic elements 500 of adjacent radiating elements (arrays) 220 may be in the range of 40% to 60% of the wavelength corresponding to the center frequency of the operating frequency band of the parasitic element 500. Likewise, the spacing between the radiators 300 of adjacent radiating elements (arrays) 220 may also be optimally designed based on the frequency band in which they operate.

Although exemplary embodiments of this disclosure have been described, those skilled in the art should appreciate that many variations and modifications are possible in the exemplary embodiments without materially departing from the spirit and scope of the present disclosure. Accordingly, all such variations and modifications are intended to be included within the scope of this disclosure as defined in the claims. The present disclosure is defined by the appended claims, and equivalents of these claims are also contained.

That which is claimed is:

1. A radiating element, comprising:

a feed stalk;

a radiator that is fed by the feed stalk;

a parasitic element that includes an electrically conductive structure that comprises a meandered electrically conductive path; and a coupling capacitor that is formed between the electrically conductive structure and the radiator, wherein a center frequency of an operating frequency band of the radiator is higher than a center frequency of a first operating frequency band of the parasitic element, and wherein at least 70% of a projection of the electrically conductive structure of the parasitic element on a plane, on which the radiator is located, falls within the radiator.

2. The radiating element according to claim 1, wherein the operating frequency band of the radiator is a first frequency range where a return loss of the radiating element without the parasitic element is below −10 dB, wherein an operating frequency band of the radiating element is a second frequency range where a return loss of the radiating element is below −10 dB, wherein the first operating frequency band of the parasitic element is the portion of the second frequency range that is not part of the first frequency range, and wherein the operating frequency band of the radiator is more than twice as large as the first operating frequency band of the parasitic element.

3. The radiating element according to claim 1, wherein the radiator extends a first distance in a horizontal direction H, and the parasitic element extends a second distance in the horizontal direction H that is smaller than the first distance.

4. The radiating element according to claim 1, wherein the parasitic element is disposed on or above the radiator.

5. The radiating element according to claim 4, wherein the radiating element further comprises a director, which is disposed above the parasitic element.

6. The radiating element according to claim 1, wherein the parasitic element extends substantially parallel to the radiator.

7. The radiating element according to claim 1, wherein the electrically conductive structure of the parasitic element is configured as a meandered metal ring.

8. The radiating element according to claim 1, wherein the parasitic element has an opening, and wherein the electrically conductive structure surrounds the opening.

9. The radiating element according to claim 1, wherein an inductive segment extends from an outer edge of the radiator.

10. The radiating element according to claim 1, wherein the overall extending length of the electrically conductive structure is in the range of 40% to 60% of a first length, wherein the first length is equal to a wavelength corresponding to the center frequency of the operating frequency band of the parasitic element.

11. A base station antenna, comprising:

a first linear array of radiating elements; and a second linear array of radiating elements, wherein the radiating elements in the first linear array and the second linear array are each configured as the radiating elements according to claim 1.

12. A radiating element, comprising:

a feed stalk;

a radiator that is fed by the feed stalk;

a parasitic element that includes an electrically conductive structure disposed at a distance from the radiator; and a coupling capacitor that is formed between the electrically conductive structure and the radiator, wherein the radiator extends a first distance in a horizontal direction H, and the parasitic element extends a second distance in the horizontal direction H, the second distance being smaller than the first distance, and wherein an operating frequency band of the radiator is a first frequency range where a return loss of the radiating element without the parasitic element is below −10 dB, wherein an operating frequency band of the radiating element is a second frequency range where a return loss of the radiating element w is below −10 dB, wherein a first operating frequency band of the parasitic element is the portion of the second frequency range that is not part of the first frequency range, and wherein the operating frequency band of the radiator is more than twice as large as the first operating frequency band of the parasitic element.

13. The radiating element according to claim 12, wherein the parasitic element extends substantially parallel to the radiator, and wherein the parasitic element is disposed on or above the radiator.

14. The radiating element according to claim 12, wherein the electrically conductive structure of the parasitic element comprises a meandered electrically conductive segment.

15. The radiating element according to claim 12, wherein the radiating element comprises a director, which is disposed above the parasitic element.

* * * * *